US005195753A

United States Patent [19]

Brukl et al.

[11] Patent Number: 5,195,753

[45] Date of Patent: Mar. 23, 1993

[54] METHOD OF PLAYING A GAME OF KNOWLEDGE

[76] Inventors: Penelope Brukl; Charles E. Burkl, both of Eight Allenby Dr., Ft. Salonga, N.Y. 11768

[21] Appl. No.: 672,382

[22] Filed: Mar. 20, 1991

[51] Int. Cl.[5] ..... A63F 9/18

[52] U.S. Cl. ..... 273/429; 273/431

[58] Field of Search ..... 273/429, 430, 431, 432, 273/299, 300, 302, 272, 273, 153 R

[56] References Cited

U.S. PATENT DOCUMENTS 4,466,614 8/1984 Bachman et al. ..... 273/272 X
4,911,452 3/1990 Marchese, Jr. ..... 273/272 X

OTHER PUBLICATIONS

"Junior Jumble" Puzzle, Washington Post Comics, Second Section, p. 1, May 20, 1979.

*Primary Examiner*—William H. Grieb
*Attorney, Agent, or Firm*—Emmanuel J. Lobato

[57] ABSTRACT

A knowledge game played with categories of scrambled words. The players unscramble the words, and the first to complete unscrambling in a category being played, calls for a STOP. Points are allocated for correctly unscrambling every word as well as for unscrambling less than all the words. Rounds of play are repeated until a winning score is obtained.

9 Claims, 3 Drawing Sheets

| ROUND TOTAL ____ | ROUND TOTAL ____ | ROUND TOTAL ____ | ROUND TOTAL ____ |
|---|---|---|---|
| 1. | 1. | 1. | 1. |
| 2. | 2. | 2. | 2. |
| 3. | 3. | 3. | 3. |
| 4. | 4. | 4. | 4. |
| 5. | 5. | 5. | 5. |
| 6. | 6. | 6. | 6. |
| BONUS CARD ___ ANSWER TOTAL ___ | BONUS CARD ___ ANSWER TOTAL ___ | BONUS CARD ___ ANSWER TOTAL ___ | BONUS CARD ___ ANSWER TOTAL ___ |

FIG. 4

METHOD OF PLAYING A GAME OF KNOWLEDGE

COPYRIGHT NOTICE

Copyright 1990, Penelope Brukl and Charles E. Brukl. All Rights Reserved.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

Numerous word games and games of knowledge exist. A common feature of these games involves imposing a question to the player or players, and requiring the player to draw upon his or her knowledge in order to answer the question. If the player has only limited knowledge about the subject under consideration, he will have little success in answering the questions. As a consequence, the player is apt to become discouraged and will derive little enjoyment from the game.

SUMMARY OF THE INVENTION

The present invention is an educational game which provides most effective means for improving mental proficiency, recall and retention of facts, and for building and enhancing the knowledge of the player. The present invention also provides a background knowledge of important, meaningful, and valuable information.

One of the educational objectives of this game is to provide important background knowledge of our culture. The game provides a broad and excellent balance of knowledge in categories on science, history, geography, politics, sports, entertainment, people, and general trivia.

In contrast to other word or knowledge games, the present invention has the advantage of providing the answers as part of the game. Other category games provide only the category titles, and the player has to provide the answers for each category.

According to the present invention, the question is posed to the player in the form of the answer as a scrambled word. As used herein, scrambled word means strings of letters or symbols which, if reordered, form a word or a phrase. More particularly, the player is confronted with a list of scrambled words pertaining to some identified category. The player then plays against time by unscrambling the words as fast as possible. The player will receive a point value for each correctly unscrambled word, and a bonus point value for correctly unscrambling every word presented in a round of play. The game is continued until a predetermined winning point value total has been accrued.

The game is advantageously played with two to four players, but it may be played with a single player or with a larger number. The preferred embodiment of the game is a board game, but it may be also played as a computer implemented game or on special purpose game hardware designed for the purpose.

Because the game provides the answers in categorized segments, an excellent technique for learning is employed. Learning facts in related groups or clusters rather than singularly, separately, or unrelated to other facts is acknowledged to be a potent learning and retention mechanism. Information is learned, memorized, and retained more effectively when introduced and taught in groups of interrelated facts.

BRIEF DESCRIPTION OF THE DRAWINGS

FIG. 4 illustrates an answer sheet for unscrambled words and scoring.

DETAILED DESCRIPTION OF THE INVENTION

Figure 1:
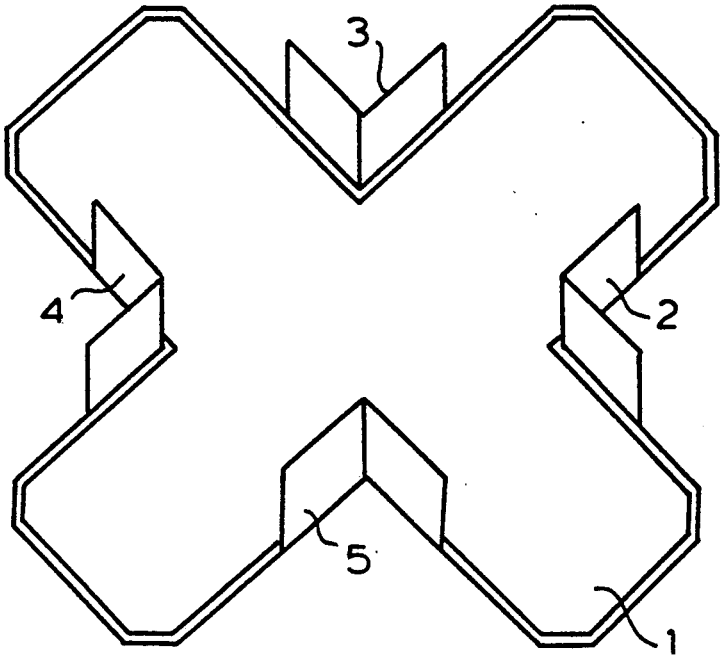
FIGS. 1 and 2 illustrate a support and holder for game cards for use with the present invention.
Figure 2:
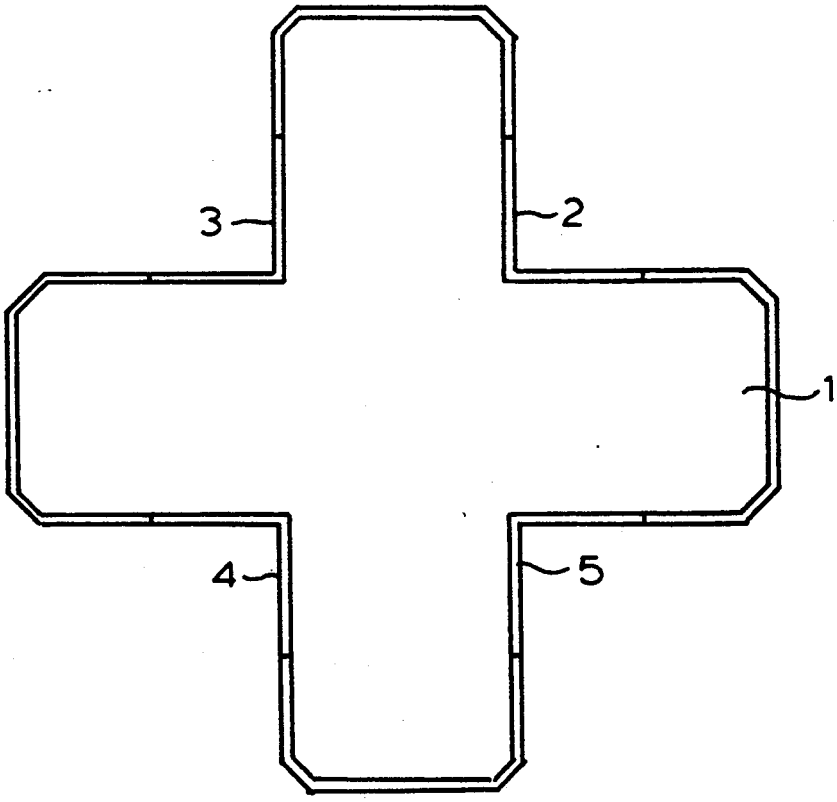
Figure 3:
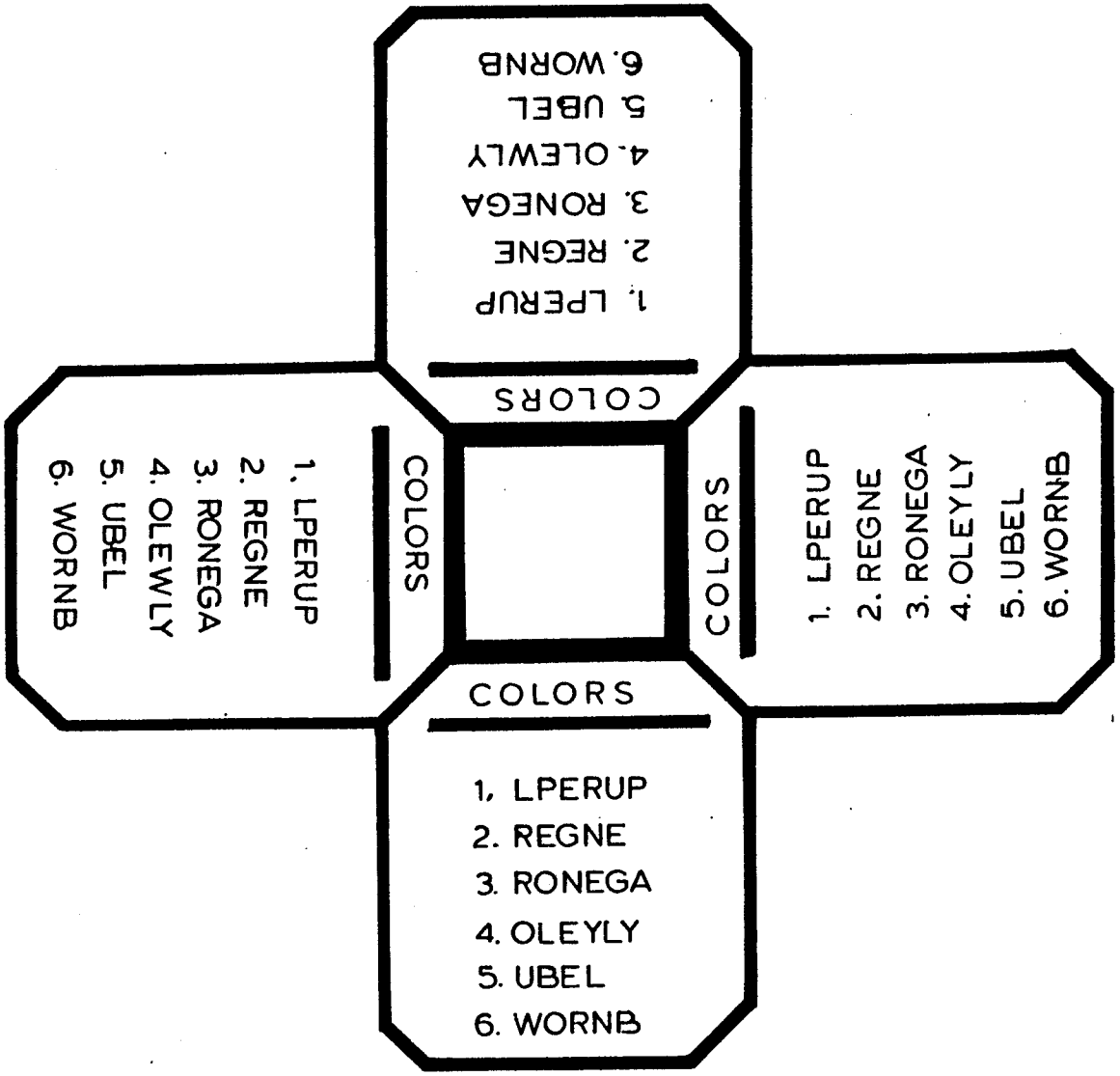
FIG. 3 illustrates a game card showing scrambled words for a particular category.

The game according to the invention can be played as a board game comprising a plurality of printed cards which are held in position by a suitable holder. FIGS. 1 and 2 illustrate a base, 1, for supporting cross-shaped cards thereon. The cross-shaped game card is illustrated in FIG. 3, and in playing position, the card is held in place by upstanding holders 2, 3, 4, 5, of FIGS. 1 and 2. The holders 2–5 are sufficiently high to allow a multiplicity of the cards to be stacked on top of each other during the course of play. FIG. 4 illustrates an answer sheet upon which each player writes his unscrambled answers for multiple categories. Provision is made on the answer sheet for recording numerical scores in each round.

The game is comprised of successive category rounds. The object of the game is to accumulate the highest total score by winning the most points in each category round.

In each category round the players identify the answers of the particular category by unscrambling the words or phrases on the category card. Word unscrambling is done as fast as possible. The object of the players is to be the first player to complete the unscrambling of every word in the category.

The game is played with a plurality of category cards, for example, five hundred with category information on both sides. Advantageously, many categories are available to the players to allow extensive play without having to repeat categories and without permitting memorization. The category cards may be color-coded with each color corresponding to a different bonus point value. In the preferred embodiment there are six answers in each category, but this number can be changed.

The players of the game may also be provided with a supply of blank answer sheets, FIG. 4, having sufficient space to answer for one or more categories, and for each category having a number of answer positions corresponding to the number of answers in each category. Advantageously, an answer key will also be provided. Each cross-shaped category card may be provided with a number used for locating the category within the answer key, and its corresponding unscrambled answers.

Play is commenced by placing a plurality of category cards, FIG. 3, in the cardholder, FIGS. 1 and 2. A cover card is placed on top, and a sample category card is placed on top of the cover card. The sample category card allows the players to familiarize themselves with the format of the category card and facilitates understanding of the rules of play. The cardholder with its supply of category cards is placed central to the players. One of the players is selected to be a scorekeeper.

Play commences with the removal of the cover card. The players identify the scrambled words as quickly as possible and write down the unscrambled, correctly spelled answers.

The player who finishes first with all the answers from the category card written down calls for a STOP to the play. That player reads his answers to the other players, and if all the answers are correct, he wins that round of play.

The player that won the round of play receives a bonus point value corresponding to the category card from which play just occurred. If there are any errors in the player's answers, he receives no bonus points, but must deduct the bonus point value for that category card from his score. Every player, including the player who won the round, receives a point value, e.g. two points, for each identified and correct answer. Particular words on a category card may also have bonus points associated with them. At the end of the round of play, each player totals the number of points and bonus points earned for that round of play and reports the total to the scorekeeper.

If more than one player calls for a STOP at the same time, and each of those players has all of the correct answers, the players will each receive a predetermined number of bonus points, regardless of the bonus points determined by the category card.

Play is continued by removing the finished category card from the deck to reveal the next card, and a new category round is played in the manner just described. At the end of that round of play, points are again totaled, and the cumulative score for each player is maintained by the scorekeeper throughout the game. Successive category rounds are played until the game has a winner. The player with the highest total cumulative score wins. The game is played for a minimum number of rounds, e.g. twenty-five rounds, and at the end of the minimum number of rounds, the cumulative scores of the players are compared. By mutual agreement, the players may play as many rounds beyond the minimum as they desire.

Various modifications and variations to the disclosed embodiment may be made. The game is not limited to English language words, but it may include words of other languages as well. The game need not be implemented as a board game. A personal computer can be programmed to operate in a mode for playing the game with a computer, and with the computer acting as an opponent. This is a particularly advantageous way of playing the game if it is to be played by a single person. Therefore, the disclosed preferred embodiment should be taken as illustrative, and not limiting, and the scope of the invention is defined by the following claims:

We claim:

1. A method of playing a game, comprising:

(i) defining one topic category which is intelligible and communicated to a player of the game;

(ii) providing to a player a plurality of correct scrambled answer words each of which pertains to the topic category;

(iii) unscrambling the words pertaining to the topic category;

(iv) awarding a point value to the player for each correctly unscrambled word;

(v) playing successive rounds of play each comprised of steps (i), (ii), (iii) and (iv) until a predetermined winning point total has been accrued.

2. A method according to claim 1, wherein the step of defining one topic category is carried out in each round of play to define different categories for different rounds of play.

3. A method according to claim 1, wherein the step of defining one topic category is carried out in each round of play to define the same category for different rounds of play.

4. A method according to claim 1, wherein the scrambled answer words comprise phrases.

5. A method of playing a game, comprising:

(i) defining a single topic category which is intelligible and communicated to a player of the game;

(ii) providing to a player a plurality of correct scrambled answer words each of which pertains to the topic category;

(iii) unscrambling the words pertaining to the topic category for as many words as a player can unscramble.

6. A method according to claim 5, further comprising: awarding a point value to the player for each correctly unscrambled word.

7. A method according to claim 5, wherein the scrambled answer words comprise phrases.

8. A method according to claim 2 wherein more than one player plays the game; and said unscrambling the words of a group is stopped when the first player completes unscrambling the words.

9. A method according to claim 5, wherein a single player plays the game, and said unscrambling the words of a group is stopped after a predetermined period of time.

* * * * *